United States Patent [19]

Zawick

[11] 4,254,719

[45] Mar. 10, 1981

[54] TAPE GUIDING ACCESSORY FOR SEWING MACHINES

[76] Inventor: George Zawick, Zawick Manufacturing Company, 1706 N. Main St., Hellertown, Pa. 18055

[21] Appl. No.: 145,598

[22] Filed: May 1, 1980

[51] Int. Cl.[3] ..... D05B 37/04

[52] U.S. Cl. ..... 112/130; 112/122; 112/125; 112/152

[58] Field of Search ..... 112/130, 122, 152, 136, 112/125

[56] References Cited

U.S. PATENT DOCUMENTS

| | | | |
|---|---|---|---|
| 2,070,200 | 2/1937 | Ernst | 112/130 |
| 3,011,460 | 12/1961 | Haff | 112/130 |
| 3,548,767 | 12/1970 | Williams | 112/130 |
| 4,020,776 | 5/1977 | Haff | 112/130 X |

*Primary Examiner*—H. Hampton Hunter

*Attorney, Agent, or Firm*—Howson and Howson

[57] ABSTRACT

An overedge sewing machine having a reciprocating trimmer knife is used to sew elastic tape to a fabric. The elastic tape is fed through a tape guide which is movable from a rest position in which it guides the tape toward the stitch-forming mechanism of the sewing machine in the direction of material movement, to a second position in which it guides the tape to a position to be cut off by the trimmer knife. The tape guide includes a controllable tension which is located close to the stitch-forming mechanism when the tape guide is in its rest position to effect instant control of gathering. The tape guide is controlled by a knee shift which is movable from a rest position, through a "gathering" position, to a "cut-off" position. A stop mechanism requires the application of significant additional pressure on the knee shift to move it from the "gathering" position to the "cut-off" position.

10 Claims, 29 Drawing Figures

FIG. 9.
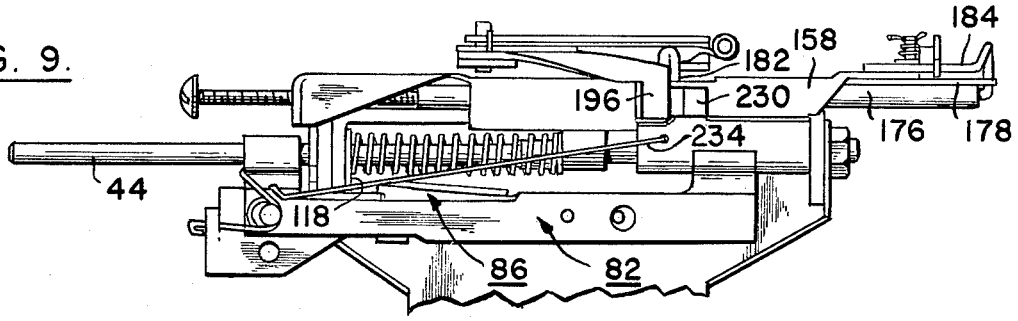
FIG. 10.
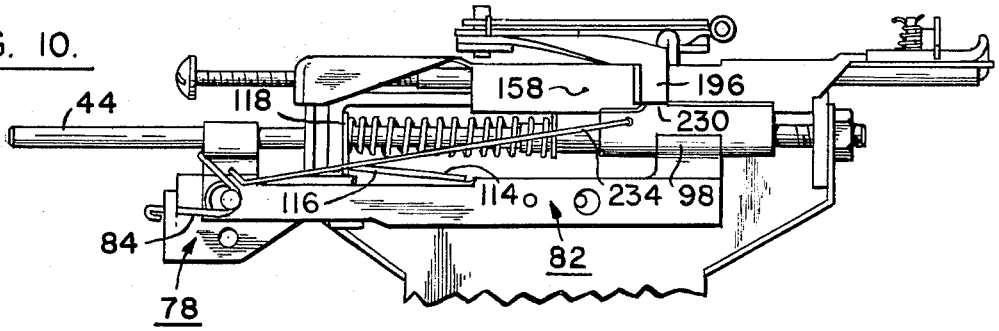
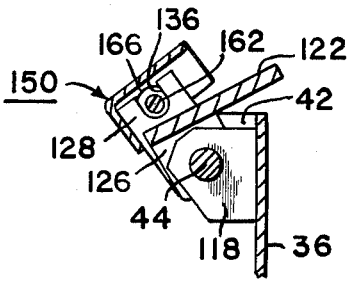
FIG. 11.
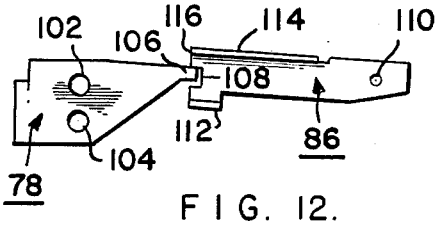
FIG. 12.
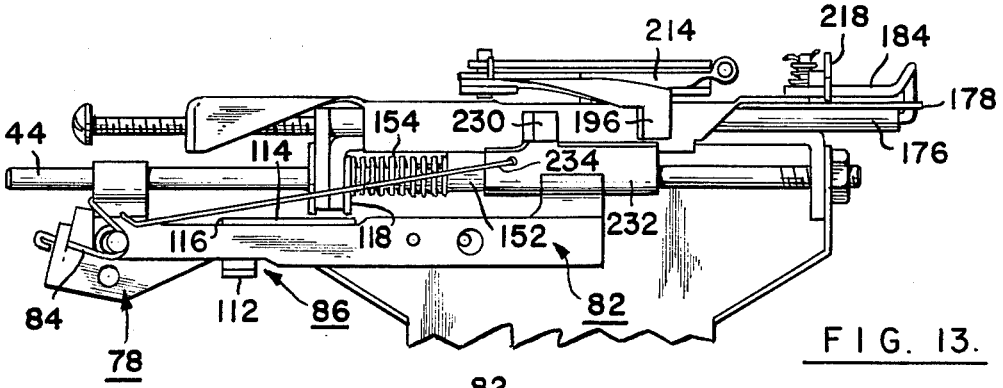
FIG. 13.
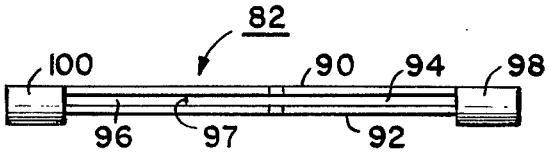
FIG. 14.

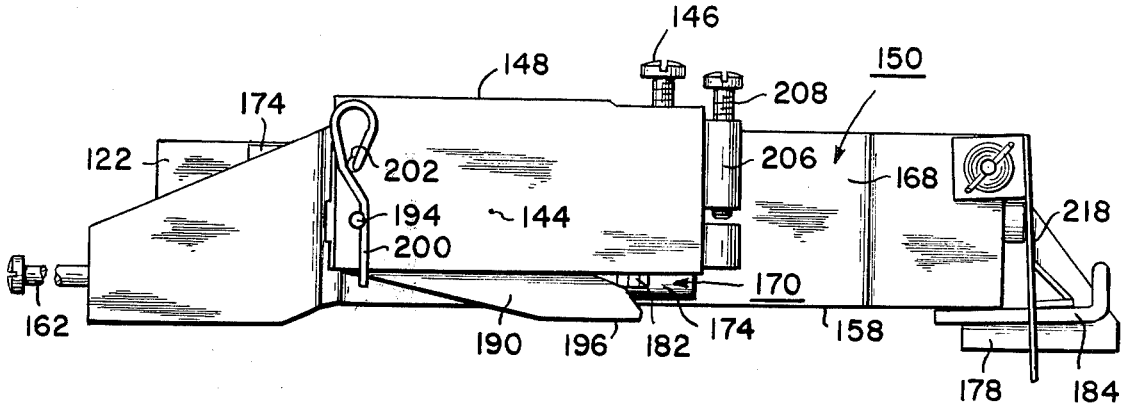
FIG. 15.
FIG. 16.
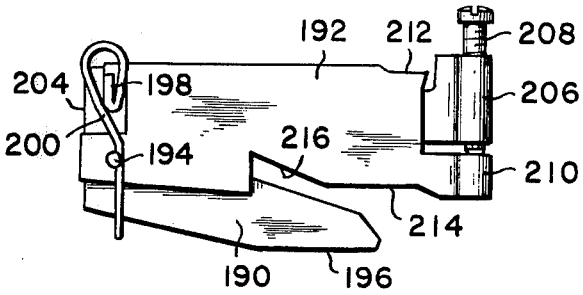
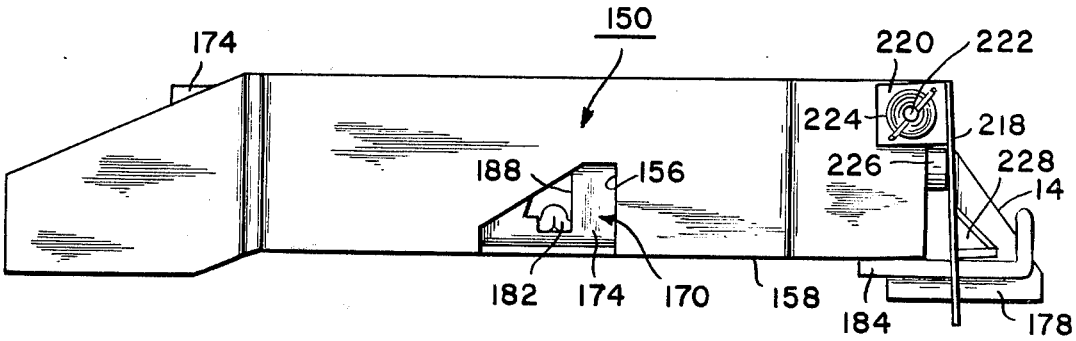
FIG. 17.
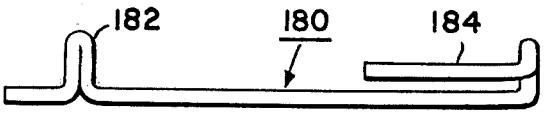
FIG. 18.

FIG. 19.
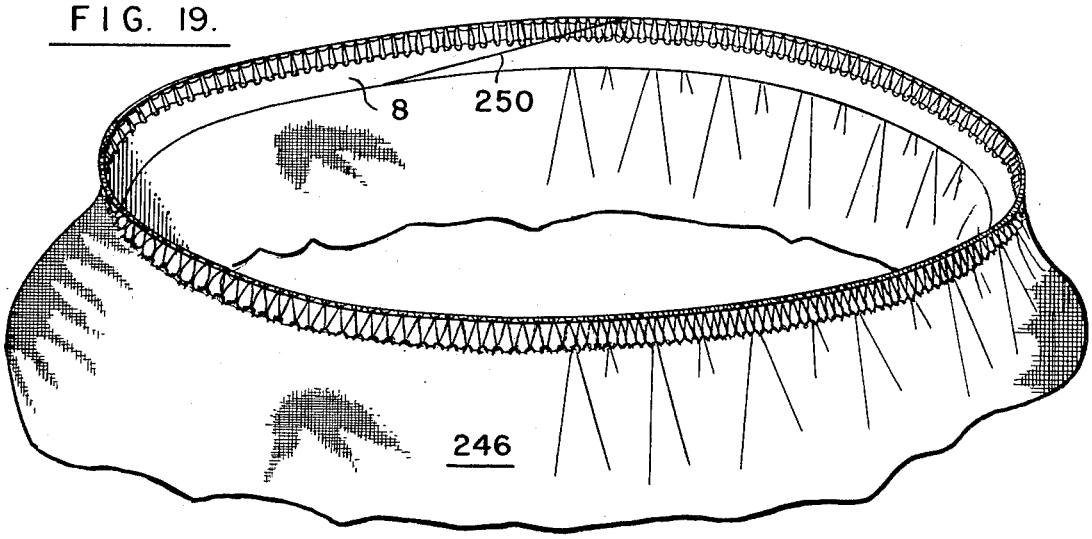
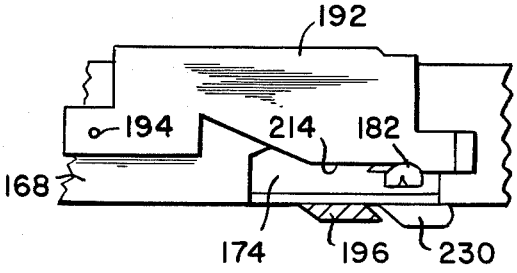
FIG. 20.
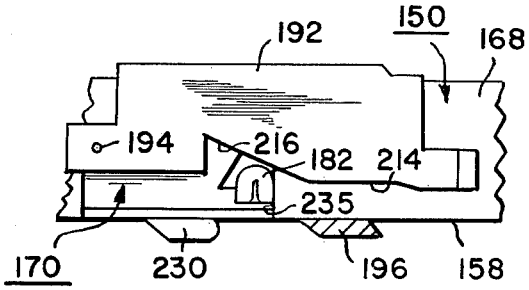
FIG. 22.
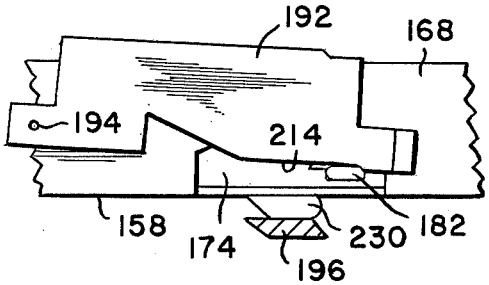
FIG. 21.
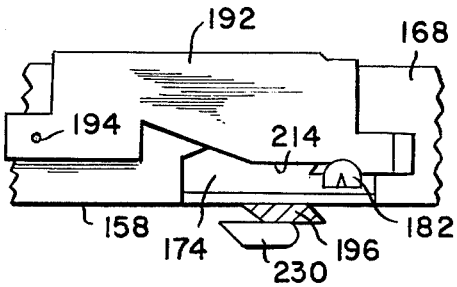
FIG. 23.

TAPE GUIDING ACCESSORY FOR SEWING MACHINES

BRIEF SUMMARY OF THE INVENTION

This invention relates to a sewing machine accessory for guiding tapes, such as elastic tapes, toward the stitch-forming station of a sewing machine and for effecting cut-off of the tapes.

A clothing manufacturer frequently has occasion to sew narrow tapes of material to a garment. For example, many swimsuits have tapes of elastic material attached to their waist and leg openings. Non-elastic tapes, including ribbons, fabric tubing and the like are frequently sewn to larger areas of garment fabric as trim.

Sewing of tapes to garments is usually carried out on a sewing machine equipped with a device for guiding the tape from the tape supply to the stitch-forming station of the machine. The guide usually has an adjustable tensioning device for applying tension to the tape as it approaches the feed mechanism to effect gathering. When sewing of the tape to the garment is completed, sewing on the tape is continued while the garment is manually pulled away from the stitch-forming station a sufficient distance to provide clearance allowing the operator to cut the tape with hand-held scissors.

The usual tape sewing operation is very insufficient in several respects. The continued sewing on the tape to allow the garment to be pulled away from the stitch-forming station causes a waste of tape. The operator cuts the tape at the point at which it meets the garment, leaving a length of tape extending rearwardly from the stitch-forming station of the sewing machine. The operator must then cut off this length of tape with the scissors either before or after the next sewing operation. This length of tape is wasted. Typically, the amount of waste is around four inches per sewing operation. An operator sewing tapes into the leg openings of a bathing suit may produce seventy five dozen garments in a working day. If four inches of tape are wasted for each leg opening, the total wastage is two hundred yards of tape per day.

The usual tape sewing operation is also inefficient in that a substantial amount of time is required to cut the tape twice per sewing operation using hand-held scissors. The time required to cut the tape in some cases amounts to as much as 25% of the operator's active time. This means that if the time spent in cutting is eliminated, there is a potential production increase of 33%.

Furthermore, the speed of production and the extent of wastage are interrelated. In most cases, the faster the machine operator attempts to work, the more tape is wasted in sewing each garment.

Another problem in sewing tapes using conventional methods and equipment is the fact that, unless cuttings with the scissors is carried out with considerable care, tags of tape material are left on the garment which can cause discomfort to the wearer.

These problems have long been recognized in the garment industry, and a number of sewing machine attachments have been proposed with the objective of improving the efficiency of tape sewing operations. However none of the devices proposed thus far has provided an acceptable solution. None has been widely used. Most tape sewing operations are still carried out in the manner described above with the attendant problems tape wastage, low production rates, and deficiencies in product quality.

The tape sewing attachments proposed in the past are subject to various problems including one or more of the following.

Some require extensive modifications to the sewing machine. For example a power take-off is required to operate some tape attachments.

Some prior tape attachments are only capable of accommodating tape of a particular width.

Most prior tape attachments have tensioning devices which are located too far from the feed mechanism of the sewing machine. The greater the distance, the more time is required for the desired amount of tension to build up in the tape. The slow build-up of tension gives rise to product quality deficiencies in some garments.

Most prior tape attachments are bulky, block the operator's view of the stitch-forming station of the sewing machine, are complex and costly, are difficult to set up and attach to the sewing machine, and are difficult to operate.

Most prior tape attachments are usable with only one particular model of sewing machine, and require considerable modification to be usable with other machines.

Most prior tape attachments which include tension adjustments and cutting means require complicated separate controls for tension and cut-off.

Most prior tape attachments which are capable of guiding a tape above the fabric cannot be used to guide the tape below the fabric.

The main objects of this invention are to improve the efficiency of tape sewing operations, and to improve product quality.

Among the other objects of the invention are the avoidance of the deficiencies of earlier proposed tape guiding accessories and specifically to provide a tape guide accessory which (a) requires a minimum of modifications to the sewing machine with which it is used; (b) is adjustable to accommodate tapes of various widths; (c) is capable of building up tension instantly in an elastic tape; (d) does not block the operator's view of the stitch-forming station; (e) is relatively simple and inexpensive; (f) is usable on a wide variety of sewing machines with a minimum of modification to the machine; (g) is easily installed and removed from a sewing machine; (h) is capable of guiding tape either above or below the fabric depending on the desire of the operator; (i) is easily set up; and (j) is easily operated.

Most sewing machines used to sew elastic tape into garments are of the "overedge" type described for example in U.S. Pat. Nos. 2,825,294, dated Mar. 4, 1958 and 3,933,104, dated Jan. 20, 1976. A typical overedge sewing machine has a cutter, located adjacent its feed mechanism, for trimming the edge of the material as it approaches the stitch-forming station. In an overedge machine the edge trimmer is important in order to insure a uniform margin between the line of stitch formation and the edge of the material. Various other types of sewing machines, such as "safety-stitch" machines also are typically equipped with edge trimmers.

The most important feature of the invention is the fact that it takes advantage of the edge trimmer by using it to effect cut-off of the tape. This is accomplished by providing a tape guide which is selectably movable between a rest position and a cut-off position. In the rest position, the tape extends from the guide toward the feeding mechanism of the sewing machine in the direction of material movement. In the cut-off position, the tape extends diagonally from the tape guide toward the feeding mechanism and is drawn by the feeding mechanism past the edge trimmer and cut off by the edge trimmer. The operator can cut off the tape at will simply by shifting the tape guide to its cut-off position. No time is wasted cutting tape with hand-held scissors, and waste of tape is greatly reduced. With an overedge machine, the cut end of the tape is underneath the overedge seam. Consequently the work has a superior finish in comparison with work produced using conventional methods.

The manner in which the subsidiary objects of the invention are achieved, and various other objects and advantages of the invention will be apparent from the following detailed description when read in conjunction with the drawings.

BRIEF DESCRIPTION OF THE DRAWINGS

FIG. 9 is a fragmentary rear elevation showing the tape guide in its rest position;

FIG. 10 is a fragmentary rear elevation showing the tape guide in its tension position;

FIG. 11 is a fragmentary view showing a stop which allows the operator to feel the tension position of the knee shift;

FIG. 12 is a fragmentary view showing details of a pivoted catch and its operating element, the catch being arranged to cooperate with the stop of FIG. 11;

FIG. 13 is a fragmentary rear elevation of the tape guide assembly in its cut-off position;

FIG. 14 is a top plan view of a slide arm of the tape guide;

FIG. 15 is an elevational view of the main slide, also showing a housing for the tape-tension operating elements;

FIG. 16 is an elevational view of the tape-tension operating elements;

FIG. 17 is an elevational view of the main slide with the housing for the operating elements removed;

FIG. 18 is an elevational view of the tension bar;

FIG. 19 is a perspective view of an arm, leg or waist opening of a garment having a tape sewn to it using the tape guide in accordance with the invention;

FIGS. 20, 21, 22 and 23 are diagrammatic views showing the successive steps in the operation of the slide mechanism;

DETAILED DESCRIPTION

The invention can be used with sewing machines of various types having edge trimmers located adjacent the fabric feeding means. However, as edge trimmers are typically present in overedge sewing machines, the invention will be described with reference to an overedge machine 2, shown in FIG. 1. Overedge sewing machines are widely used, particularly in industrial sewing operations, to form a one, two or three thread seam along the free edge of the workpiece. In operation, these machines pass successive loops of a needle thread through the workpiece at spaced intervals along a line of stitch formation spaced inwardly and parallel to the edge of the workpiece. The successive loops are either interlooped with themselves or with one or two looper threads around the edge to complete the overedge seam. In machines of this type, a trimming blade is oscillated in a plane which is fixed relative to the machine frame and parallel to the line of stitch formation. The workpiece is fed past the oscillating knife which trims the edges of the material parallel to and at a fixed distance from the line of stitch formation. An overedge machine is especially well adapted for sewing a tape to the edge of a workpiece.

Figure 1:
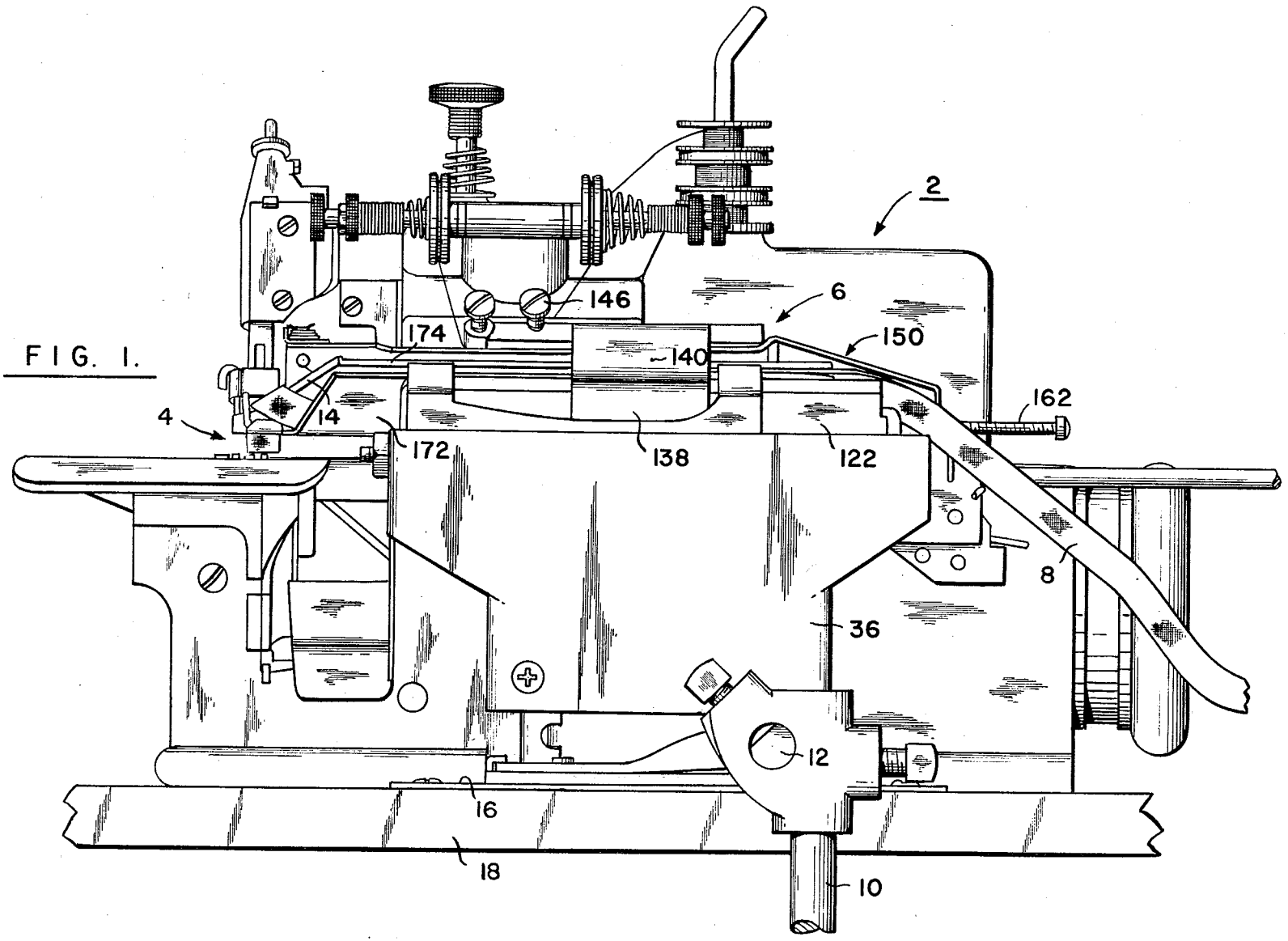
FIG. 1 is a front elevation of a sewing machine equipped with a shiftable tape guide in accordance with the invention.

In FIG. 1, tape guide 6 is used to guide tape 8 toward stitch-forming station 4. The tape is typically, although not necessarily, an elastic tape used to gather the arm, leg or waist openings of a garment such as a bathing suit. Tape 8 passes through tape guide 6 in a direction generally perpendicular to the direction of the feed of fabric through stitch-forming station 4. The tape, however, changes direction and is guided toward the stitch-forming station over an oblique edge 14 at the left-hand end of guide 6.

Tape 8 is preferably delivered to tape guide 6 from a strip feeder of the kind described in my U.S. Pat. No. 3,911,842, issued Oct. 14, 1975, the disclosure of which patent is here incorporated by reference. The strip feeder comprises a roller, which moves at a peripheral speed greater than the demand of the sewing mechanism. The tape is wound about the roller, and the roller operation reduces variations in tension at the location of the sewing mechanism by isolating the sewing mechanism from the effects of tape supply roll inertia.

The operator controls tape guide 6 by movement of operating lever 10, which preferably takes the form of a knee shift. Lever 10 rotates a shaft 12 which effects both tension control and tape cut-off through the mechanism which will now be described.

The tape guide mechanism is removably secured to a metal plate 16, which is fastened to sewing machine table 18 and positioned directly in front of the sewing machine, i.e. between the sewing machine and the operator.

Figure 2:
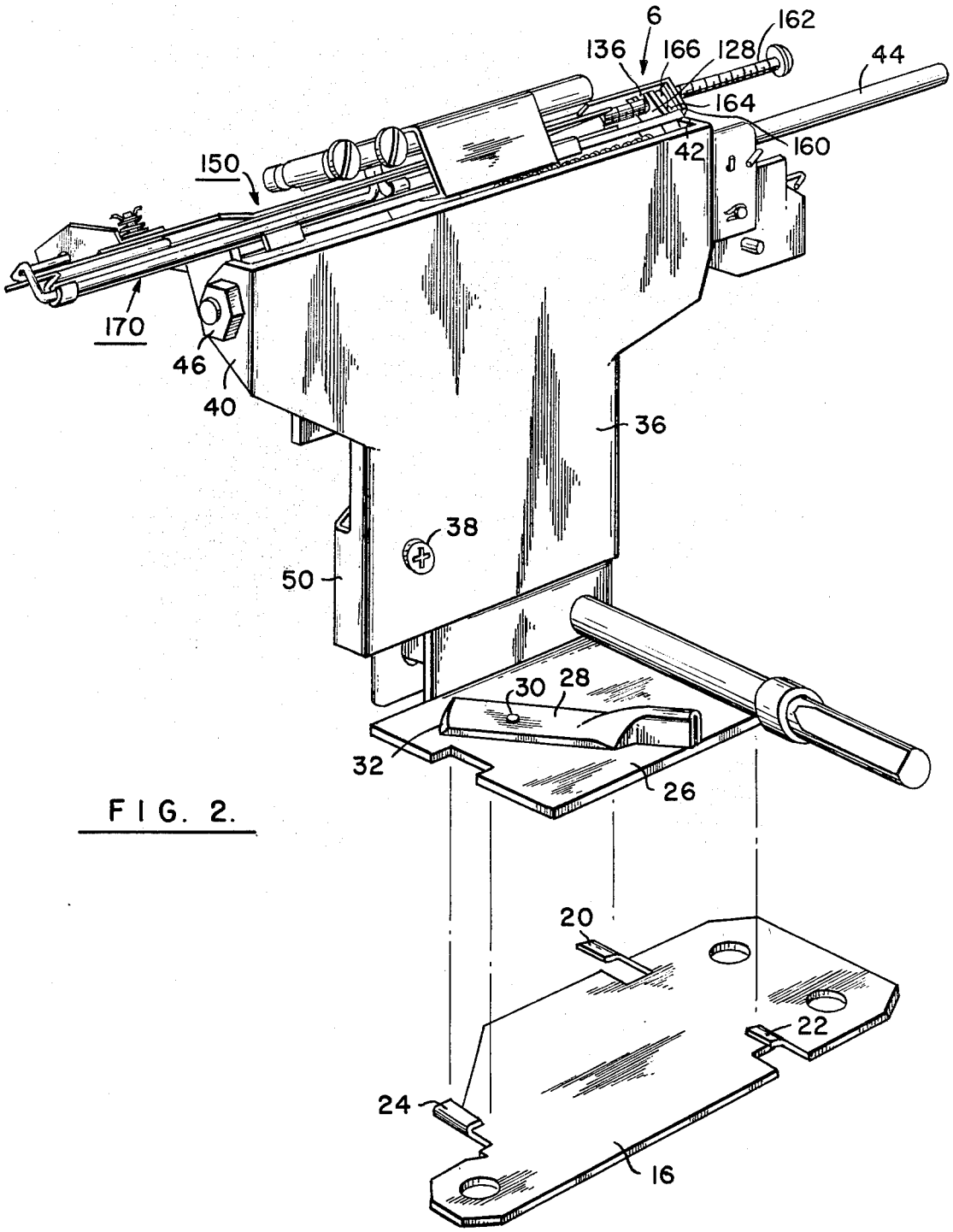
FIG. 2 is an exploded view illustrating the manner in which the tape guide is removably secured to the sewing machine table.

As shown in FIG. 2, plate 16 has two struck-out retaining tabs 20 and 22 facing in one direction, and a third struck-out retaining tab 24 facing in the opposite direction. These tabs receive tape guide base plate 26, which is locked in place on plate 16 by latch 28. The latch is pivoted on a pin 30, and has a beveled edge 32 adapted to move underneath tab 24 to fasten the tape guide securely to plate 16. The tape guide assembly can be readily installed and removed from in front of the sewing machine by the operation of latch 28.

Base plate 26 is generally L-shaped, and has a unitary, vertically extending wall 34 at its rear edge. A generally T-shaped main bracket 36 can be secured on vertical wall 34 at any desired position within a range of vertical positions. Locking screw 38 is used to lock bracket 36 to wall 34 at the desired height. The vertical movability of bracket 36 relative to base plate 26 permits the tape guide to be adapted to a variety of different sewing machines. It further permits the tape guide to be positioned so that it can be used to guide tape either on top of or below the fabric to which it is to be sewn.

Bracket 36 has two rearwardly projecting ears 40 and 42 at the opposite ends of its upper part. A rod 44 extends through aligned holes in these ears, and is locked against movement toward the right by a nut 46 which is threaded onto the left-hand end of rod 44. Rod 44 serves as a guide on which the tape guide slides. It also allows the tape guide to be tilted. Tilting of the tape guide is accomplished by loosening nut 46, rotating the tape guide to the desired orientation, and retightening the nut. Normally, the tape guide will be positioned, as shown in FIG. 1, and in the remaining drawings, so that the tape extends obliquely downwardly from the tape guide toward the stitch-forming station, to meet the fabric from above. However, if main bracket 36 is lowered, and the tape guide is adjusted to a more nearly horizontal condition, the tape can be made to approach the stitch-forming station from underneath the fabric.

Figure 3:
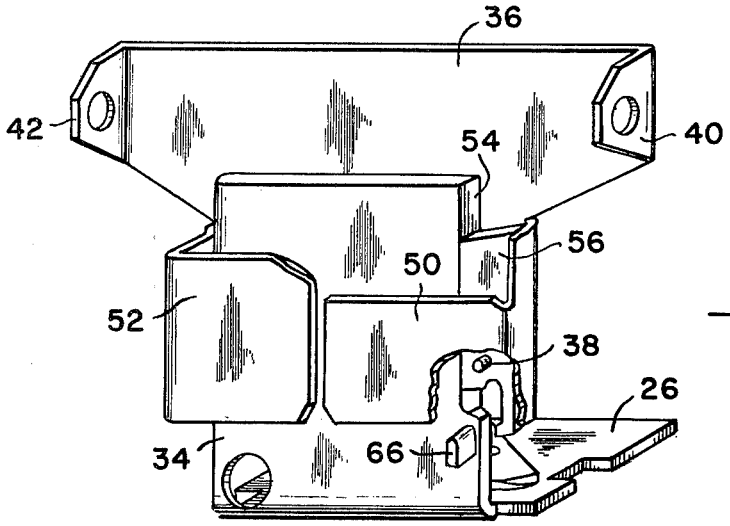
FIG. 3 is a perspective view from the rear of the main tape guide bracket illustrating the manner in which the bracket is secured to a base plate.
Figure 4:
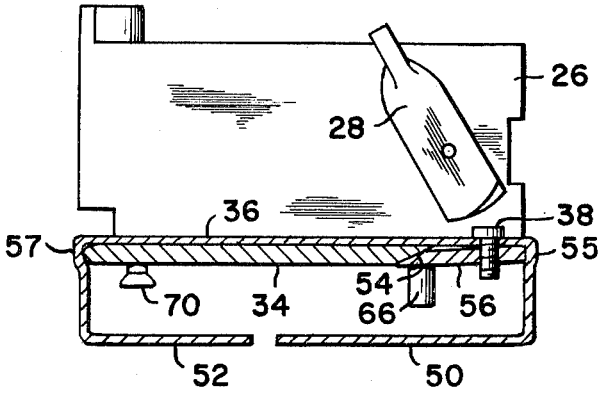
FIG. 4 is a horizontal section through the apparatus of FIG. 3.

FIGS. 3 and 4 show how bracket 36 is secured to wall 34 of the base plate. A generally rectangular enclosure 48 is formed by rearwardly and inwardly extending arms 50 and 52 of bracket 36. Wall 34 has a beveled edge 54, which cooperates with the beveled edge of a plate 56 located alongside plate 34. Plate 56 has a threaded hole receiving locking screw 38. As shown in FIG. 4, the right-hand edge of plate 56 is held in a depression 55 formed in arm 50. In a similar manner, the left-hand edge of wall 34 is held in a depression 57 formed in arm 52. By tightening locking screw 38, the beveled edges of plate 56 and wall 34 are brought tightly together and cooperate to lock bracket 36 securely to wall 34 at any desired position within a range of vertical positions.

Figure 7:
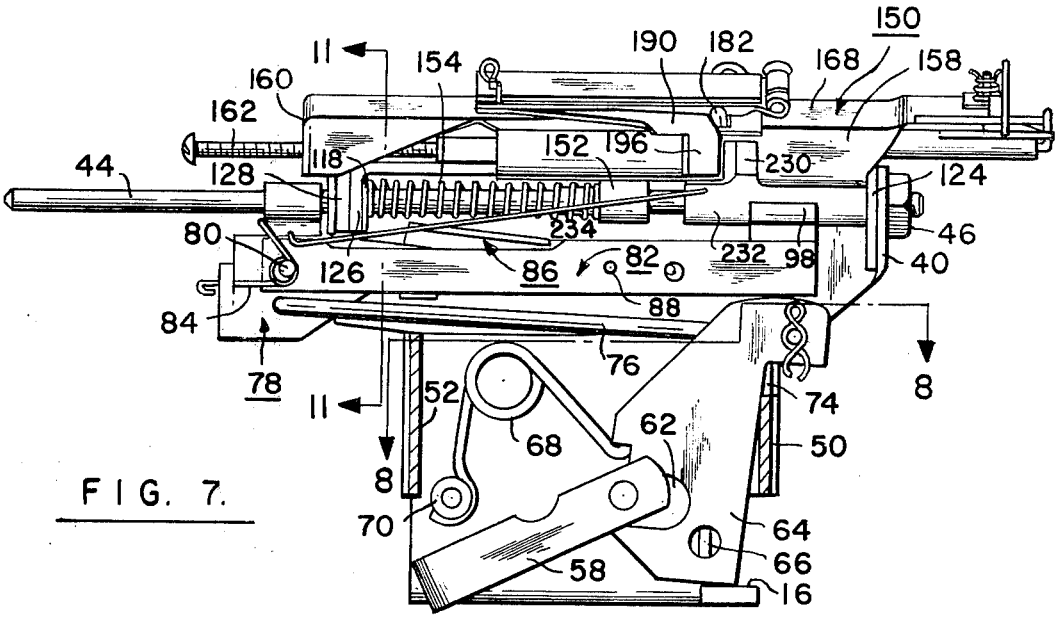
FIG. 7 is a rear elevational view of the tape guide assembly, showing details of the shift mechanism.
Figure 8:
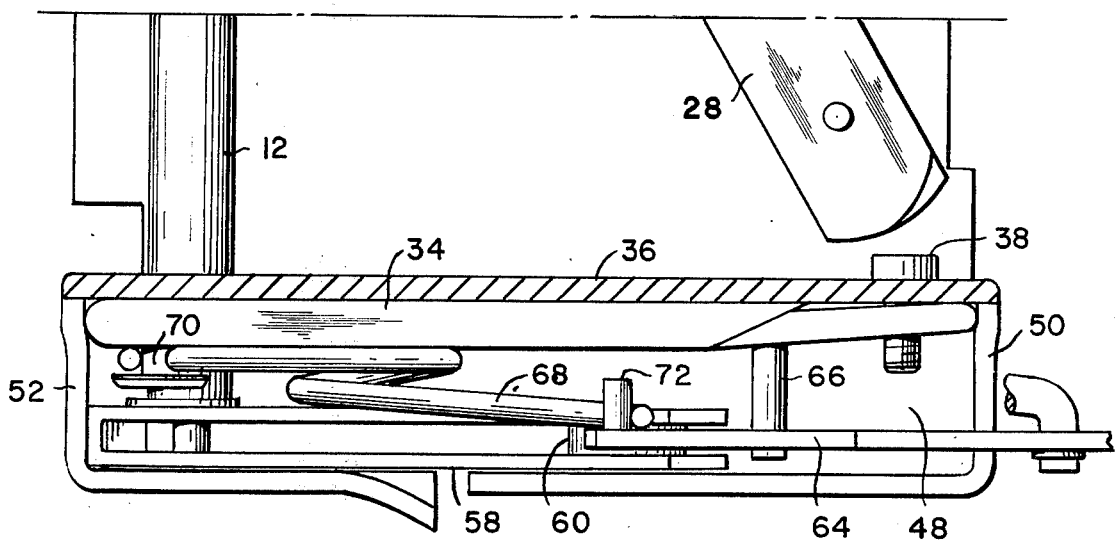
FIG. 8 is a horizontal section taken on the surface 8—8 of FIG. 7.

Referring to FIGS. 7 and 8, operating shaft 12 is secured to an arm 58 which comprises two parallel members joined at one end of the arm. Between these parallel members near the other end is a roller 60 which cooperates with a notch 62 in crank 64. Crank 64 is pivoted on a pin 66 which is secured to and extends perpendicularly from wall 34 (see FIG. 3). Spring 68 is secured between pin 70 on wall 34 and pin 72 on crank 64, and urges crank 64 in a clockwise direction, as viewed in FIG. 7. Clockwise movement of crank 64 is limited by contact between crank edge 74 and arm 50 of bracket 36, as shown in FIG. 7. A connecting rod 76 is connected to the upper end of crank 64. When the connecting rod is disconnected from the crank, the crank can be rotated counterclockwise until the end of spring 68 underneath pin 72 comes into contact with one of the upper edges of arm 58. Arm 58 and crank 64 exhibit a toggle action such that they will remain in this position despite the presence of spring 68. Consequently, the base plate assembly, including arm 58, spring 68, and crank 64 can be readily installed in enclosure 48 in an assembled condition.

Connecting rod 76 is connected between the crank 64 and element 78, which is pivoted on pin 80 at the left-hand end of slide arm 82, as shown in FIG. 7. Element 78 is urged in a counterclockwise direction about its pivot by spring 84. Element 78 serves as a control element for catch 86, the purpose of which is to require the application of significant additional pressure on the knee shift to move it from the gathering position to cut-off position.

The details of element 78 and catch 86 are shown in FIG. 12, while the details of slide arm 82 are shown in FIG. 14. Slide arm 82 comprises two parallel side elements 90 and 92 joined by a web 94. The web extends from the right-hand end of element 82 to an intermediate location 97. From location 97 to the left-hand end of element 82, an opening 96 is provided to accommodate element 78 and catch 86. Loops 98 and 100 are formed in element 90 at opposite ends of the slide arm. These loops receive rod 44, as shown in FIG. 7.

Referring to FIG. 12, element 78 has a hole 102 for receiving pivot pin 80, and a hole 104 to which connecting rod 76 (FIG. 7) is secured. Element 78 also has a projection 106 which extends into a slot 108 at the left-hand end of catch 86. Catch 86 has a hole 110 which receives one leg of U-shaped pivot pin 88, the other leg of which extends through an adjacent hole in slide arm 82 (FIG. 7). Catch 86 has a laterally extending lower flange 112 adapted to engage the lower edge of slide arm side element 92 (FIG. 14), and a laterally extending upper flange 114 adapted to engage the upper edge of side element 92. These laterally extending flanges limit the pivoting movement of catch 86 and element 78. Edge 116 of upper flange 114 engage stop 118 (FIGS. 7 and 11) when the slide arm moves to the left as shown in FIG. 10.

The right-hand edge of stop 118, as viewed in FIG. 11, is engaged with the inside wall of bracket 36. This engagement prevents stop 118 from rotating when the tilt of the slide assembly is adjusted, and therefore maintains the proper relationship between stop 118 and catch 86.

The action of slide arm 82 is best understood from FIGS. 9, 10 and 13, which show the three principal positions of the slide arm. FIG. 9 shows the normal or rest position in which the slide arm is in its right-most location on rod 44. In FIG. 10, the slide arm is moved to the "gathering" position, and end 116 of the upper flange of catch 86 abuts stop 118. The machine operator can feel the abutment of these two elements in the knee shift, and consequently knows that the knee shift is properly positioned for gathering. The manner in which the tape is tensioned for gathering when slide arm 82 is in this position will be described below with particular reference to FIGS. 20–23 and 26.

Additional pressure on the knee shift overcomes the force exerted on pivoted element 78 by spring 84, and causes element 78 to tilt clockwise, as shown in FIG. 13. The clockwise tilting of element 78 causes catch 86 to rotate in a counterclockwise direction, so that end 116 of its upper flange 114 clears stop 118. This allows slide arm 82 to move further toward the left on rod 44 to shift the tape guide to position the "cut-off" shown in FIG. 13.

Figure 6:
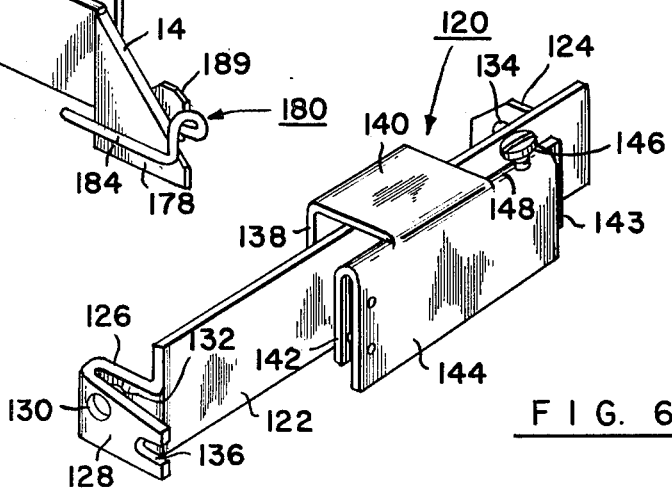
FIG. 6 is an oblique perspective view of a tiltable frame by which the tape guide is secured to the main bracket.

The tape guide mechanism is supported in frame 120 shown in FIG. 6. The frame comprises a plate 122 having an ear 124 at one end, and an ear 126 at the other end. Ear 126 has a return flange 128. When the device is assembled, ears 126 and 124, and return flange 128 are located between ears 42 and 40 (FIG. 3) of bracket 36. Ear 124 of frame 120 is adjacent ear 40 of bracket 36, as shown in FIG. 7. Aligned holes 130, 132 and 134 are provied for rod 44. Hole 134 is threaded to receive the threads at the end of rod 44. Ear 40 is clamped between ear 124 and nut 46 as shown in FIG. 7. When nut 46 is loosened, the frame is rotatable about the rod axis to allow the tape guide to tilt. However, the frame itself is not axially slidable.

Return flange 128 has a slot 136 to receive a screw used for adjusting the tape guide to accommodate various tape widths. Leg 138 of bracket 140 is welded to plate 122. At the opposite end of the bracket a housing is formed comprising depending wall elements 142 and 143, which define a two-part rear wall, and depending front wall element 144. These wall elements are all parallel to the face of plate 122, and wall elements 142 and 143 are spaced rearwardly from wall element 144. A minimum tension adjusting screw 146 is threaded into web 148 which connects wall element 143 to wall element 144.

A main slide 150 as shown in FIGS. 1, 2, 7, 15 and 17. A sleeve 152 (FIG. 7), formed on the underside of the main slide, embraces rod 44 and constrains slide 150 to movement parallel to the axis of rod 144 while permitting the slide to be tilted. As viewed in FIG. 7, sleeve 152 is engaged by the right-hand end of coil spring 154 on rod 44. The left-hand end of the spring bears against stop member 118. Coil spring 154 is in compression, and therefore urges slide 150 to the right.

Slide 150 has an opening 156, best seen in FIG. 17, which is provided for a tension bar tab. Slide 150 has a side wall 158 (FIG. 7) which serves as a guide for a tension-operating cam. An end wall 160 (FIG. 2) is provided with a slot 164 receiving adjusting screw 162. This adjusting screw extends through slot 136 in flange 128 of frame 120. A nut 166, which is immovably secured on screw 162, is located between flange 128 and end wall 166. The engagement of end wall 160, nut 166 and flange 128 limits the movement of slide 150 under the influence of coil spring 154.

Figure 5:
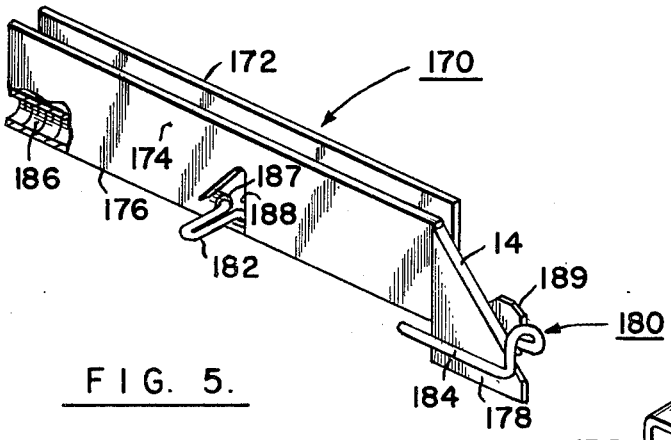
FIG. 5 is an oblique perspective view of a tape tension assembly which constitutes part of the tape guide.

A tape tension assembly 170 is located below upper wall 168 of main slide 150. Assembly 170 is shown more fully in FIG. 5 and comprises a sheet metal housing having side walls 172 and 174 joined by a web 176. Wall 174 is folded to provide oblique edge 14 which serves to change the direction of the tape. A plate 178 is also formed by the fold at the end of wall 174. Plate 178 cooperates with a tension element 184 of tension bar 180 to apply tension to the tape after it passes over edge 14, and as it approaches the stitch-forming station of the sewing machine. Tension bar 180 is configured as shown in FIG. 18, and is bent to form a tab 182 near the end opposite tension element 184. As shown in FIG. 5, the tension bar extends between side walls 172 and 174 of the tension assembly, and tab 182 extends outwardly through an opening 188 in side wall 174. A bearing is formed at 187 in the tension assembly, which receives the end of the tension bar. A tab 189 extends upwardly from web 176, and is bent over bar 180 in the final assembly to provide another bearing which cooperates with bearing 178 to constrain bar 180 for rotational movement such that, as tab 182 is moved downwardly, as viewed in FIG. 5, tension element 184 moves toward tension plate 178.

Portions of side walls 172 and 174 are struck inwardly, and threaded at 186 to receive adjusting screw 162. As will be appreciated from FIGS. 2 and 7, adjusting screw 162 serves to adjust the position of tension assembly 170 with respect to frame 120. As screw 162 is turned clockwise, tension assembly 170 moves toward the left in FIG. 7. Since nut 166 is held between flange 128 and end wall 160 (FIG. 2) when the slide is in the position shown in FIGS. 2 and 7, the position of tension assembly 170 is entirely under the control of adjusting screw 162. If main slide 150 is moved toward the left, however, end wall 160 moves away from flange 128, and tension assembly 170 can move through a short range relative to slide 150. The limits of this range are established by engagement of nut 166 with end wall 160, and by the engagement of tab 182 with the right-hand edge of opening 156 as viewed in FIG. 7. As slide 150 moves toward the left, tension assembly 170 remains stationary until tab 182 contacts the right-hand edge of opening 156. This causes the tape guide opening to widen, allowing the tape to approach the sewing machine feed mechanism diagonally without being distorted. As slide 150 moves further toward the left, tension assembly 170 follows it by reason of the continued engagement between tab 182 and the edge of opening 156.

FIG. 15 shows main slide 150, and front wall 144 of the U-shaped housing of frame 120. Between the walls of this U-shaped housing are a cam follower 190 and a tension operator 192, shown in FIG. 16. Both of these elements are pivoted on a pin 194 which extends through aligned holes in front wall 144 and rear wall element 142. A spring 200 is lodged in a notch in pin 194. One of its ends is curled around and retained by the lower edge of wall 144 as viewed in FIG. 15. The spring insures that pin 194 remains in place. For the removal of pin 194, the spring is moved toward the right to disengage it from the notch.

Spring 200 extends through hole 202 in wall 144, and the opposite end 198 of the spring bears against a forwardly extending tab 204 on cam follower 190, urging the cam follower in a counterclockwise direction about pivot pin 194. This forces element 196 of follower 190 against side wall 158 of slide 150 (FIGS. 7 and 15).

A threaded sleeve 206, formed on the right-hand side of cam follower 190, receives an adjusting screw 208, the lower end of which is arranged to contact cylindrical element 210 formed at the right-hand end of operator 192.

Movement of element 196 away from side wall 158 of slide 150 causes the lower end of the adjusting screw to push downwardly against cylindrical element 210, thereby causing operator 192 to rotate clockwise about pivot pin 194. The upper edge of operator 192 is bent over at 212 to form a surface for contact with adjusting screw 146 (FIG. 15) to limit the counterclockwise movement of operator 192. Lower edge 214 of operator 192 serves to press downwardly on tension bar tab 182. Screw 208 is used to adjust the upper limit of tension, while adjusting screw 146 may be used to establish and adjust a lower limit.

The lower edge of operator 192 is notched at 216 in order to release tension on the tape when the tape tension assembly 170 slides to the left relative to frame 120. Notch 216 also facilitates assembly by providing a clearance allowing tab 182 of the tension bar to be moved underneath edge 214 of operator 192.

An edge guide plate 218, shown in FIG. 17, has a flange 220, which overlies slide 150 and is held down by a spring 224 on pin 222. Clockwise rotation of the edge guide is limited by a loop of metal 226 formed at the right-hand edge of slide 150. Edge guide 218 serves as a guide for the tape as it approaches the stitch-forming station of the sewing machine from oblique edge 14 of plate 178. A notch in guide 218 provides clearance for tension element 184. A triangular flange 228 extends laterally from guide 218, and overlies tension plate 178. This flange raises the tape passing over plate 178 just before it reaches tension element 184 to facilitate operation of the tension mechanism.

The operation of the tension mechanism and of the slide will now be described.

Referring again to FIG. 7, a cam 230 extends upwardly from a slide 232 which rides on rod 44. Slide 232 is shown abutting ear 124 of frame 120. It embraces loop 98 of slide arm 82, and consequently, cam 230 moves with arm 82. Cam 230 is held against side wall 158 of slide 150 by the action of spring 234. Slide 232 is spaced from sleeve 152, thereby establishing a lost-motion relationship between the operating lever and main slide 150, preventing the main slide from shifting the tape until the operating lever is moved past the gathering position. Unless spring 154 is excessively strong, however, this simple lostmotion mechanism, by itself, will not insure that the operator will be able to feel the limit of the gathering range in the knee shift. This is why catch 86 and stop 118 are used.

Again referring to FIGS. 9, 10 and 13, as slide arm 82 moves toward the left from its rest position catch 86 encounters stop 118, as shown in FIG. 10. The resistance felt by the operator in the knee shift increases suddenly. As slide arm 82 moves to the position shown in FIG. 10, cam 230 moves between element 196 and side wall 158, thereby rotating element 190 about its pivot pin 194. This causes edge 214 of the tension operator to push against tab 182 of the tension bar. The tension bar rotates so that tension bar 184 approaches tension plate 178, applying pressure to the tape.

As slide arm 82 moves further toward the left, as shown in FIG. 13, slide 232 pushes sleeve 152 and main slide 150 toward the left against the urging of coil spring 154. Cam 230 clears element 196, and tension element 184 is released. Slide 150 moves to the left until tension bar tab 182 engages the right-hand edge of opening 156 (FIG. 7). Consequently, slide 150 moves a short distance relative to the tension bar, causing the opening between guide 218 and the end of the tension bar to widen. This allows the tape to approach the stitch-forming mechanism diagonally without distorting.

The action of cam 230 and follower element 196 will be best understood by reference to FIGS. 20–23, which illustrate the sequence of operation. FIG. 20 shows the cam and follower element in the rest condition. In FIG. 21, as cam 230 moves to the left, it moves between wall 158 and element 196. The edges of the cam and follower element and beveled to accomplish this result. Tension operator 192 tilts clockwise about pin 194, and its edge 214 engages tension bar tab 182, and pushes tab 182 downwardly to rotate tension bar element 184 against tension plate 178 (FIG. 10).

In FIG. 22, can 230 has cleared element 196, allowing operator 192 to rotate counterclockwise to its original position. Edge 235 of opening 156 engages tab 182, moving the tension assembly 170, including tension bar 180 to the left to a position in which tab 182 clears edge 214, and is located adjacent notch 216. With the tension bar in this position with respect to operator 192, tension element 184 can be moved a considerable distance away from tension plate 178. Thus tension on the tape is completely eliminated even if screw 146 (FIG. 15) is set to establish a high minimum degree of tension. This position of the slide can be used to load tape into the tension mechanism, and also to remove and replace the tension bar.

In FIG. 23, cam 230 is shown returning to its original position. As it returns, the beveled configuration of follower element 196 causes cam 230 to pass over element 196 on the side away from wall 158. Thus, on the return movement of the slide, cam 196 remains against wall 158, and tension element 184 is not tightened against tension plate 178.

As shown in FIG. 1, tape extends through the tape guide between the side walls 172 and 174 of the tape 8 tension assembly 170, and over edge 14 toward the stitch-forming station 4 of the sewing machine.

The manner in which the tape guide cooperates with the sewing mechanism is best seen in FIGS. 24–27.

Figure 24:
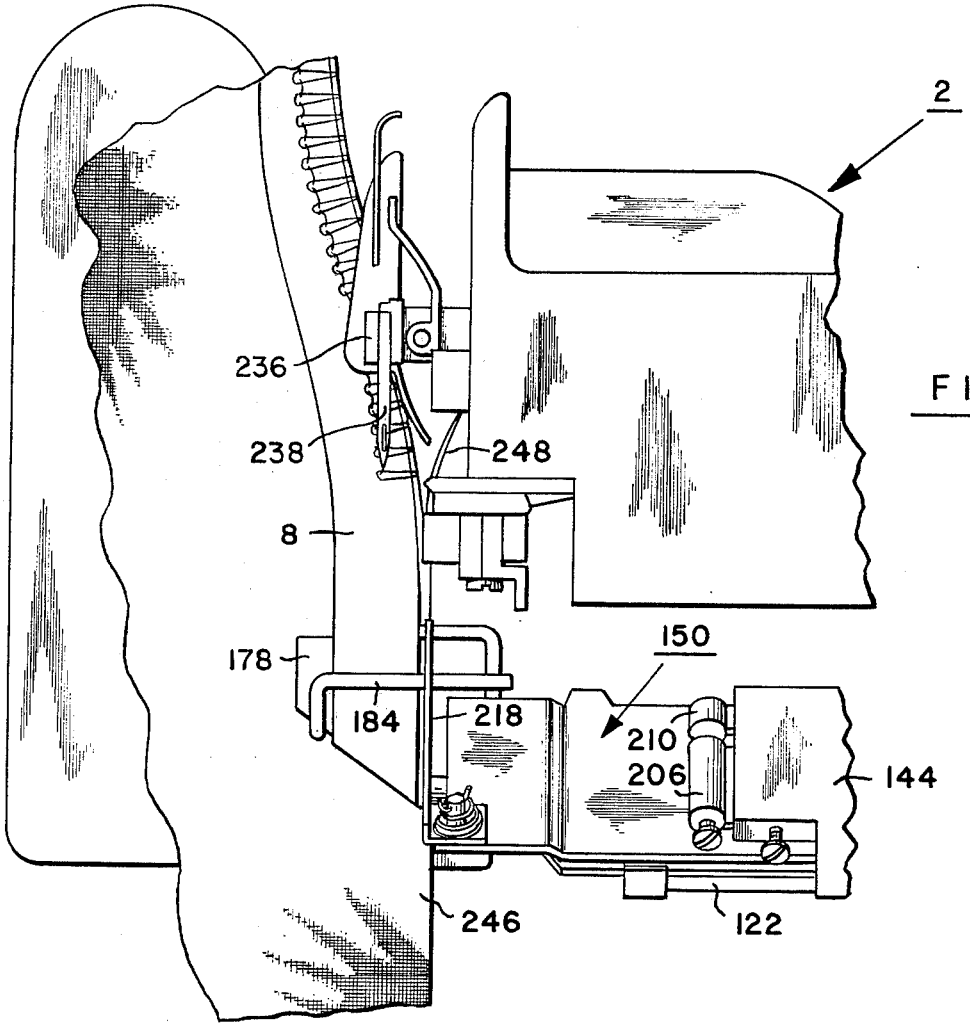
FIG. 24 is a top plan view showing the stitch-forming station of a sewing machine, and showing the tape guide in its rest position.
Figure 27:
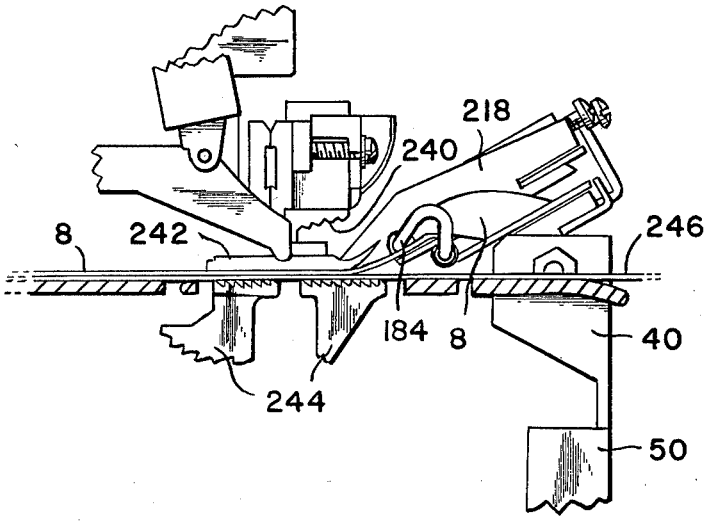
FIG. 27 is a diagrammatic elevational view of a stitch-forming station, illustrating the manner in which a tape is guided by the tape guide toward the feed mechanism.

FIG. 24 shows the normal sewing operation in which a tape is sewn at the edge of a fabric without tension being applied. Sewing machine 2 has a needle bar 236 carrying a needle 238 which cooperates with loopers (not shown) to form stitches to secure the tape to the fabric. A vertically reciprocating trimmer blade 240 cooperates with a stationary edge (not shown) to trim the edge of the fabric, which is essential for the proper operation of an overedge sewing machine. A presser foot 242, as shown in FIG. 27, cooperates with feed dogs 244 to feed the fabric 246 along with tape 8 past the stitch-forming station 4 of the sewing machine. From FIGS. 24 and 27 it will be seen that trimmer blade 240 is located to the side of the feeding mechanism, and at a position just in front of the point at which stitches are formed by the needle and loopers. For proper operation of the tape guide of this invention, the trimmer blade should be positioned to the side of the feed dogs and so that at least part of the feed dog mechanism is located behind the rear edge of the trimmer blade. Thus, the rear feed dog of feed dogs 244 is located behind the rear edge of trimmer blade 240. This insures that the tape will continue to be drawn past the trimmer blade as it is being cut off.

In FIG. 24, the trimmed edge of the fabric is shown at 248. Tension element 184 is spaced a sufficient distance from plate 178 so that the tape is not in tension.

Figure 26:
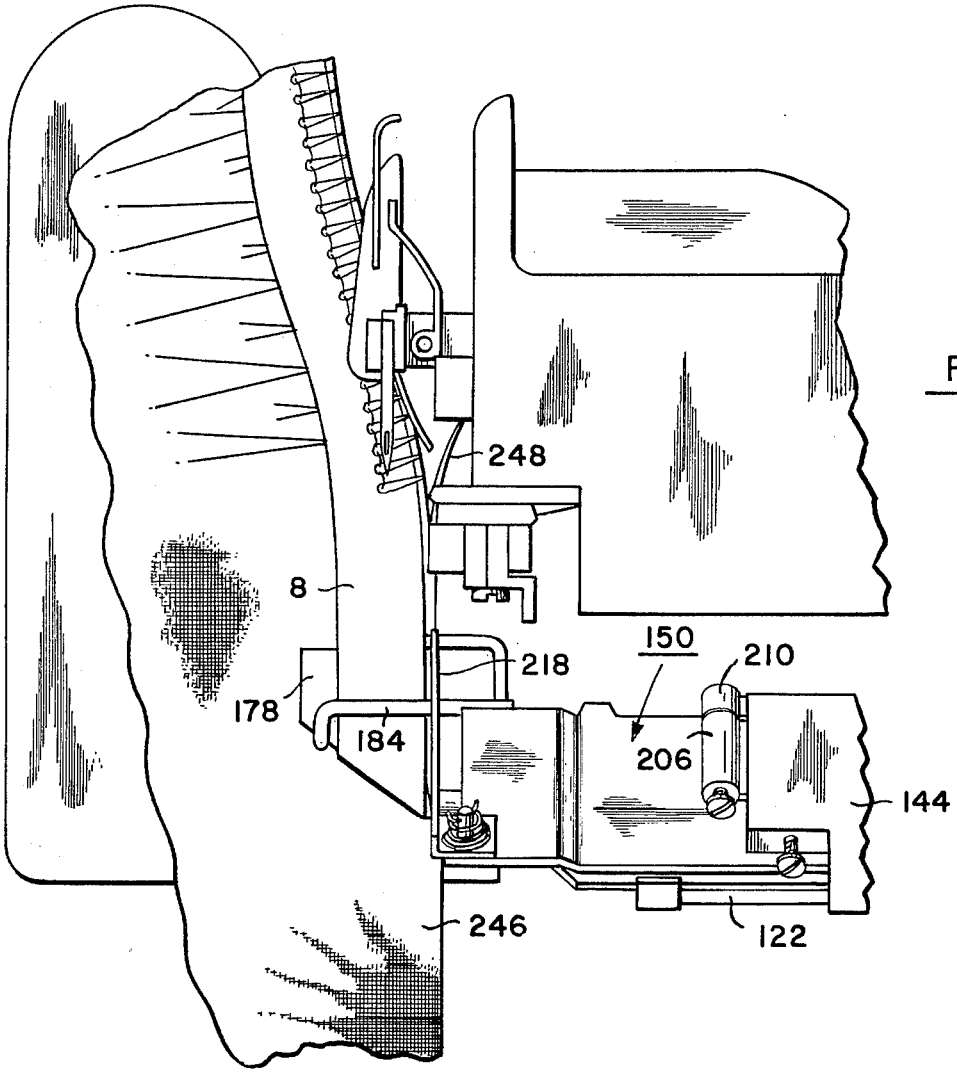
FIG. 26 is a top plan view of a stitch-forming station showing the tape guide in its gathering position.

In FIG. 26, tension element 184 is pressed downwardly to pinch the tape against tension plate 178. This causes the elastic tape 8 to stretch in the short distance between tension element 8 and the feeding mechanism (the presser foot and the feed dogs) of the sewing machine. As the tape and fabric clear the sewing mechanism, the release of tension on the tape causes the fabric to gather, as shown in FIG. 26. Tension applied to the tape is continuously adjustable, and depends on the extent to which the knee shift is moved from its rest position toward the "gathering" position. Consequently the operator can control the degree of gathering where desired. For example in the waist of a bathing suit it is frequently desired to form a slight degree of gathering in the front and a greater degree of gathering in the back. The continuous adjustment of tension makes this possible.

Figure 25:
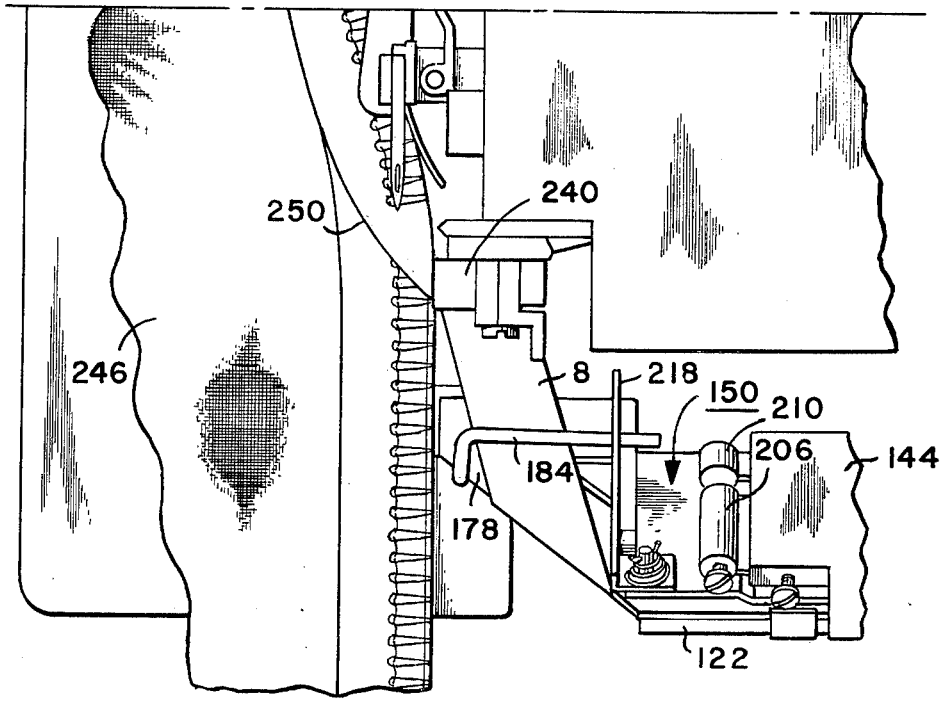
FIG. 25 is a top plan view of a stitch-forming station showing the tape guide in its cut-off position.

In FIG. 25, the tape guide is moved toward the right so that tape 8 extends diagonally from the tape guide toward the feeding mechanism of the sewing machine, and is drawn across trimmer blade 240, and cut-off. In FIG. 25, it should be noted that edge guide 218 is moved with respect to the end of tension element 184 to allow a wide space to permit the tape to extend diagonally toward the sewing machine feed mechanism. The tape extends across the line of stitch formation at location 250.

The result of the three-stage operation just described is illustrated in FIG. 19, in which an elastic tape 8 is sewn in a loop in a leg, arm or waist opening in a garment comprising fabric 246. In accordance with the usual practice, the fabric is gathered through part of the loop, and ungathered throughout the rest of the loop. Gathering can be easily controlled using the knee shift control lever 10 (FIG. 1). The tape is drawn across the trimmer blade at location 250, and neatly trimmed by the trimmer blade to produce a complete loop as shown. The cut-off end of the tape is secured underneath the stitches at the edge of the work.

Gathering can be made to occur at any stage in the formation of a loop. In the case of FIG. 19, the knee shift was moved to the gathering position at the beginning of the sewing operation, and released at a point approximately halfway through the sewing operation. At the end of the sewing operation, when the loop was completely formed, the operator moved the knee shift from its rest position to its cut-off position without stopping at the gathering position.

Figure 28:
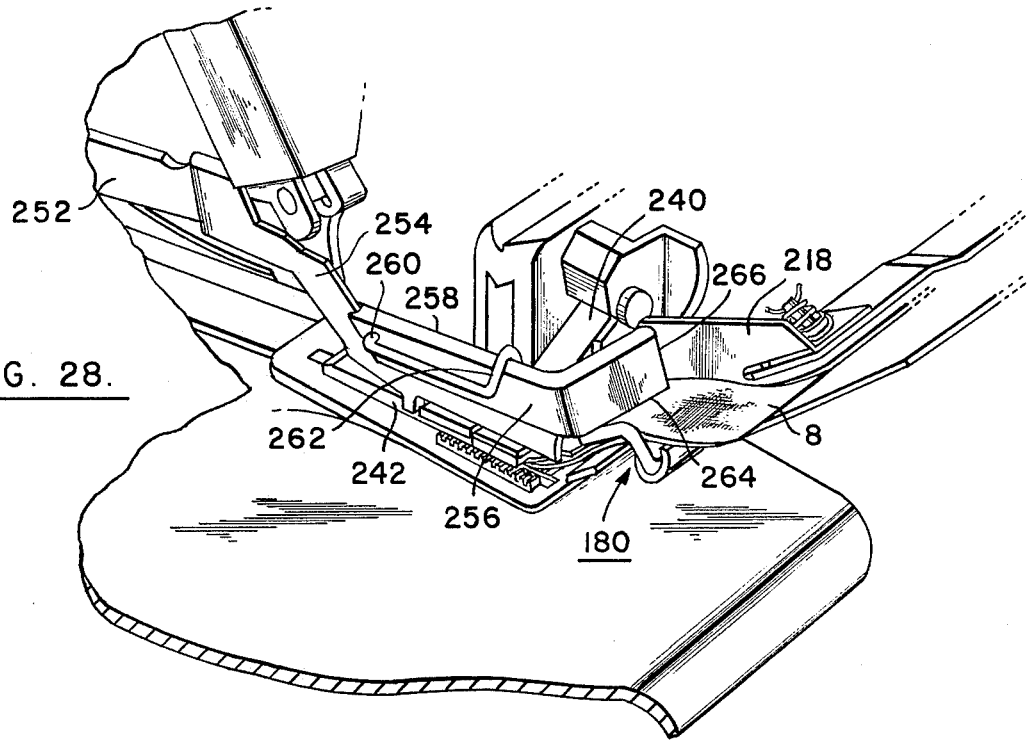
FIGS. 28 and 29 are oblique perspective views of a stitch-forming station showing the operation of a stop bar which cooperates with the tape guide to insure that the tape is properly reinserted underneath the presser foot following a cut-off operation.

FIG. 28 shows in perspective the stitch-forming station of a sewing machine with the tape guide in its normal position. The presser foot lifter bar 252 of the sewing machine is provided with a bracket 254 on which is secured an L-shaped stop 256 which is secured in place by a pin 258, end 260 of which extends through aligned holes in stop 256 and bracket 254. Pin 258 is looped over L-shaped stop 256 at 262 to prevent removal of the pin from the aligned holes in the stop and its bracket. In FIG. 28, the underside edge 264 of stop 256 rests on the loop at the end of tension bar 180.

As the tape guide is moved toward the right in a cutting-off operation, the loop at the end of the tension bar moves to the right and clears edge 264 of stop 256. Stop 256 falls to the position shown in FIG. 29. As the tape guide returns, the loop at the end of bar 180 engages end 266 of stop 256, preventing the complete return of the tape guide to its initial position until the presser foot lifter bar 252 is operated to raise the presser foot. Stop 256 moves upwardly with the presser foot until edge 266 clears the end of the tension bar, allowing the tension bar to move, underneath edge 264 of the stop, back to the position shown in FIG. 28. The presser foot can then be returned to its operative position, and moved up and down as desired without disturbing the tape guide mechanism.

Figure 29:
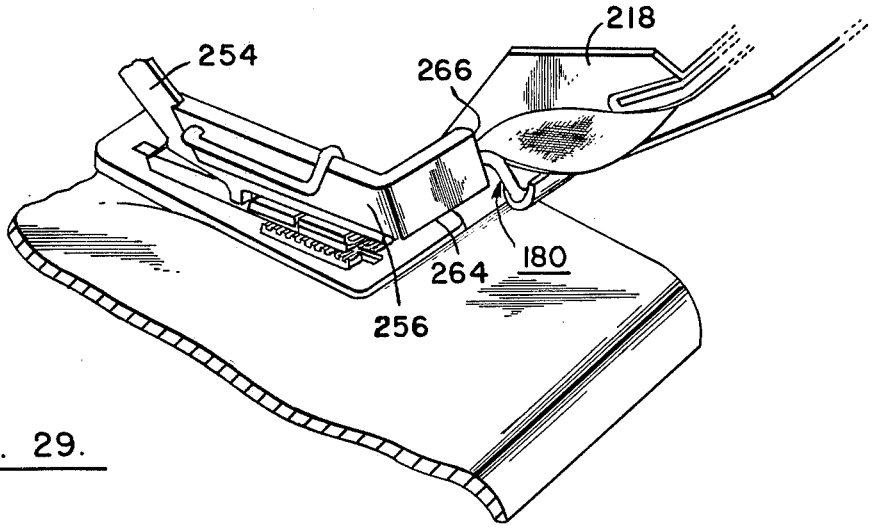

The mechanism shown in FIGS. 28 and 29 accomplishes two things. First, since the presser foot is down during cutting off of the tape, it is necessary to raise the foot before returning the tape guide to its initial position. Otherwise, the tape would become jammed against the side of the foot, and might not return to the desired position upon lifting of the foot. The sewing machine operator, of course, can avoid this by holding the knee shift in the cut-off position until after the foot is raised, removing the completed work, releasing the knee shift, and then lowering the foot. However, with the mechanism of FIGS. 28 and 29, it is unnecessary to hold the knee shift in the cut-off position. As soon as the tape is cut, the knee shift can be released. At any time thereafter, the presser foot can be raised, and the finished work can be released. At the same time, stop 256 clears the end of the tension bar, and the tape guide snaps into its original position, presenting a new length of tape underneath the foot for the next sewing operation.

The second advantage of the mechanism of FIGS. 28 and 29 is that stopping the tape guide at the position shown in FIG. 29 causes edge guide 218 to return to its initial relationship with respect to the end of the tension bar. This causes the tape to return from its diagonal position as illustrated in FIG. 25 to a condition such that the free end extends from the tape guide in the normal direction before the presser foot is raised to allow the tape to be snapped into place. The straightening of the tape before it is snapped into place insures that the tape will be properly positioned before the beginning of a new sewing operation.

In summary, by using the trimming knife of the sewing machine to effect cut-off, the invention completely eliminates the manual tape-cutting steps, thus improving production efficiency both by saving the operator's time and by eliminating waste of tape. The overedge stitches cover the cut end of the tape, producing a product having a superior finish.

The tape guide is able to effect both gathering and tape cut-off through a single knee shift control which is simpler to operate than separate controls. The operator is able to use this knee shift satisfactorily both for gathering and for cut-off because the action of elements 78 and 86 (FIG. 7) produces an unmistakeable "feel" in the knee shift which permits the operator to sense when the knee shift in in the gathering position.

The tape guide mechanism is essentially self-contained, and is attached to the sewing machine table rather than to the sewing machine itself. The only sewing machine modification which is made is the attachment of bracket 254 (FIG. 28) to the presser foot lifter bar. The tape guide can be easily installed in front of a sewing machine, and easily removed when it is not needed by the operation of a simple latch. Therefore, it is a simple matter to remove the tape guide when threading, adjusting or repairing a sewing machine. Also, in a single shop, it is possible to equip a number of sewing machines with plates corresponding to mounting plate 16 (FIG. 2), and serve all of the machines with a limited number of tape guides, which are installed on the machines only when needed. Since the tape guide is attached to the table rather than to the sewing machine, it is a simple matter to adjust the height of the main bracket of the tape guide assembly to the proper height for the sewing machine. Furthermore, the height and tilt of the tape guide are adjustable in order to feed tape underneath rather than above the work, if desired. The tape tension can be positioned within a small fraction of an inch from the feed mechanism of the sewing machine. Consequently, the delay in building up tension is insignificant. This enables the operator to control gathering much better. Even though the tension is located very close to the feed mechanism, the tape guide does not seriously interfere with the operator's view of the stitch-forming station since most of the mechanism is located to the right of the stitch-forming station, as shown in FIG. 1. Finally, the tape guide has versatility in that adjusting screw 162 permits it to accommodate any desired tape width within a wide range.

I claim:

1. In a sewing apparatus comprising in combination a stitch-forming mechanism, means for feeding material past the stitch-forming mechanism, and cutting means, located adjacent the feeding means for trimming the edge of the material being fed past the stitch-forming mechanism in a direction parallel to the direction of material movement, the improvement comprising a tape guide, and means for selectably positioning the tape guide in a first position in which the tape extends in the direction of material movement from the tape guide toward the feeding means, and in a second position in which the tape extends diagonally from the tape guide toward the feeding means and is drawn by the feeding means past the cutting means and cut off by the cutting means.

2. A sewing apparatus according to claim 1 in which the means for feeding material comprises feed dog means, a presser foot positioned above said feed dog means, and means for raising and lowering the presser foot, and in which the means for selectably positioning the tape guide comprises spring means connected to the tape guide for urging the tape guide toward its first position, means for moving the tape guide against the urging of the spring means to its second position, means connected to the presser foot for engaging and stopping the tape guide at an intermediate position when the tape guide is moving toward its first position from its second position with the presser foot lowered, and means on said tape guide for moving the length of tape extending between the tape guide and the feeding means from its diagonal position to a rearwardly extending position as said tape guide moves from its second position to its intermediate position, said engaging and stopping means being positioned to clear said tape guide, when the presser foot is raised, to allow the tape guide to move automatically to its first position under the urging of the spring means, and said engaging and stopping means being movable relative to the presser foot in a direction transverse to the direction of its engagement with the tape guide, thereby allowing the presser foot to be raised and lowered while the tape guide is in its first position, the intermediate position of the tape guide being such that the length of tape extending rearwardly from the tape guide in the intermediate position is positioned alongside the presser foot, and enabled to move smoothly between the presser foot and the feed dog means when the presser foot is raised.

3. A sewing apparatus according to claim 1 in which the tape guide has tensioning means located substantially at the point on the tape guide from which the tape extends, and means controlling the tensioning means for selectably applying and releasing tension on the tape.

4. A sewing apparatus according to claim 3 having a control lever movable through a range of positions from a normal position, said means for controlling the tensioning means being connected to said lever and operative to apply tension to the tape when the lever is moved to an intermediate position in its range and to release tension on the tape when the lever is returned to its normal position, said means for selectably positioning the tape guide also being connected to said lever and operative to move the tape guide to its second position when the lever is moved to a third position in its range beyond said intermediate position.

5. A sewing apparatus according to claim 4 including means for requiring a substantially greater pressure on the lever to move the lever beyond its intermediate position toward its third position, than is required to move the lever from its normal position toward its intermediate position.

6. A sewing apparatus according to claim 5 in which said means for requiring a substantially greater pressure comprises a stop, a movable slide arm, a catch, carried on the slide arm, and movable relative to the slide arm from a first position in which it is engageable with said stop to a second position in which it clears said stop, spring means urging said catch toward its first position, and means connecting said lever to said catch, said connecting means being arranged to effect sliding movement of the slide arm to move the catch into engagement with the stop when the lever is moved from its normal position to its intermediate position, and, upon further movement of the lever toward its third position, to disengage said catch from said stop against the urging of said spring means, and to effect further sliding movement of the slide arm, said slide arm being in lost-motion relationship with the tape guide and arranged to initiate movement of the tape guide from its first position to its second position when said catch is disengaged from the stop against the urging of said spring means.

7. A sewing apparatus according to claim 1 having means for adjusting the height of the tape guide relative to the stitch-forming mechanism.

8. A sewing apparatus according to claim 1 in which the tape guide is supported in a bracket and tiltable on said bracket about a horizontal axis which is perpendicular to the direction of material movement, and including means for adjusting the height of the bracket relative to the stitch-forming mechanism.

9. A sewing apparatus according to claim 1 in which the tape guide has tensioning means located substantially at the point on the tape guide from which the tape extends, and including means for automatically releasing the tension of the tensioning means and for automatically widening the opening of the tensioning means in the direction of the plane of the tape when the tape guide is moved to its second position.

10. A sewing apparatus according to claim 1 in which the stitch-forming mechanism includes means for producing an overedge seam whereby the edge of the tape produced by the action of the cutting means is secured underneath the overedge seam.

* * * * *